United States Patent [19]

Papazian et al.

[11] Patent Number: 4,893,715

[45] Date of Patent: Jan. 16, 1990

[54] CLOSET EXTENDER

[75] Inventors: John Papazian, New Rochelle; William Kiernan, Larchmont, both of N.Y.

[73] Assignee: Lillian Vernon Corporation, Mount Vernon, N.Y.

[21] Appl. No.: 295,199

[22] Filed: Jan. 9, 1989

[51] Int. Cl.[4] ..... A47F 5/00

[52] U.S. Cl. ..... 211/118; 211/119

[58] Field of Search ..... 248/215, 249, 317, 323, 248/327, 339, 340; 182/150; 223/85; 211/118, 117, 115, 113

[56] References Cited

U.S. PATENT DOCUMENTS

| | | | |
|---|---|---|---|
| 486,804 | 11/1892 | Wood | 248/327 |
| 794,176 | 7/1905 | Hamilton | 211/113 |
| 846,784 | 3/1907 | Davis | 248/215 |
| 1,873,039 | 8/1932 | Robinson | 248/327 |
| 2,577,397 | 12/1964 | Bailey | 211/118 |
| 2,714,965 | 8/1955 | Fitzkee | 211/113 |
| 2,972,419 | 2/1961 | Zelen | 211/113 |
| 3,162,473 | 12/1951 | George | 211/113 |
| 3,352,430 | 11/1967 | McAtee | 211/119 |
| 3,610,426 | 10/1971 | Thomas | 211/117 |
| 4,243,146 | 1/1981 | Davitz | 211/118 |
| 4,518,089 | 5/1985 | Campbell | 211/118 |

FOREIGN PATENT DOCUMENTS

| | | | |
|---|---|---|---|
| 11138 | 1/1934 | Australia | 248/215 |
| 1361427 | 4/1902 | France | 223/85 |
| 1361761 | 4/1964 | France | 223/85 |
| 7904229 | 12/1979 | Netherlands | 211/118 |
| 87536 | 4/1956 | Norway | 211/113 |

*Primary Examiner*—Ramon O. Ramirez
*Assistant Examiner*—Robert A. Olson
*Attorney, Agent, or Firm*—Salter & Michaelson

[57] ABSTRACT

A closet extender includes a pair of elongated frame members which are securable to a horizontal closet pole so that they extend downwardly therefrom in substantially parallel, spaced relation and an elongated support member which is adjustably securable to the frame members so that it extends therebetween in downwardly spaced relation to the closet pole. The frame members and the support member are preferably made of a suitable substantially rigid wire and the support member is adapted for supporting garments on clothes hangers in downwardly spaced relation to the closet pole so that two vertically spaced rows of garments can be accomodated in a closet.

4 Claims, 2 Drawing Sheets

CLOSET EXTENDER

BACKGROUND AND SUMMARY OF THE INVENTION

The instant invention relates to apparatus for hanging and supporting garments and more particularly to an apparatus of a type commonly referred to as a closet extender which is operative for increasing the capacity of a clothes closet.

While various types of apparatus have been heretofore available for supporting clothes hangers and the like in clothes closets, they have generally been less than entirely effective for optimizing the use of all available closet space. More specifically, while various types of closet extenders have been heretofore available for supporting garments in downwardly spaced relation to closet poles, the heretofore available devices of this type have generally lacked sufficient adjustability to make them versatile and adaptable for a wide variety of applications. In this regard, the heretofore available closet extenders have generally comprised a pair of elongated frame members which are securable to a closet pole so that they extend downwardly therefrom and an elongated support member which is secured to the lower ends of the frame member and operative for supporting a plurality of clothes hangers. Closet extenders of this type have generally been adapted for supporting clothes hangers in downwardly spaced relation to closet poles so that two vertically spaced rows of garments can be accommodated in closets. However, since the support members of closet extenders of this type have generally not been adjustably securable to the frame members thereof, the heretofore available closet extenders have generally not been adjustable to adapt them to fit in closets of various different sizes and configurations or to adapt them for use in connection with garments of various different types and sizes.

The instant invention provides an effective and versatile closet extender which is adapted to be adjusted for use in various different applications. Specifically, the closet extender of the instant invention comprises spaced, first and second elongated vertical frame members which are adapted to be suspended from a substantially horizontal closet pole and an elongated horizontal support member which is adjustably securable to the frame members at various different locations wherein it extends between the frame members in downwardly spaced relation to the closet pole. The support member is adapted for suspending a plurality of clothes hangers therefrom and it preferably comprises a pair of vertically spaced substantially parallel, rigid, horizontal support wire elements and a plurality of spaced, substantially parallel transverse support wire elements which extend between the horizontal support wire elements. The frame members preferrably comprise hook elements at the upper ends thereof which are receivable on a closet pole for suspending the frame members therefrom and the frame members preferably each further comprise a pair of spaced substantially parallel, rigid, longitudinal frame wire elements and a plurality of spaced substantially parallel, rigid, transverse frame wire elements which extend between the longitudinal frame wire elements thereof. Further, the support member is preferably adapted so that it is adjustably securable to the transverse frame wire elements of the frame members. In one embodiment of the closet extender, the frame members are of unitary construction and in a second embodiment, the frame members each comprise a pair of detachably connectable, longitudinally extending frame member sections. Further, in the second embodiment, each of the frame member sections preferably includes a pair of spaced, substantially parallel, rigid, longitudinal frame member section wire elements and a plurality of spaced, substantially parallel, rigid, transverse frame wire elements and the support member is detachably securable to the transverse frame wire elements of the frame member sections.

For use of the closet extender of the instant invention, the hook elements on the frame members are secured to a closet pole and the support member is secured to the frame members in substantially parallel downwardly spaced relation to the closet pole. In this regard, because the support member is adjustably securable to the frame members, the closet extender can be adapted for supporting different types of garments in various different applications so that it is possible to make the maximum use of all available closet space.

Accordingly, it is a primary object of the instant invention to provide an effective closet extender which is adjustable for various applications.

Another object of the instant invention is to provide an effective adjustable closet extender comprising a pair of elongated wire frame members and a wire support member which is adjustably securable to the frame members.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
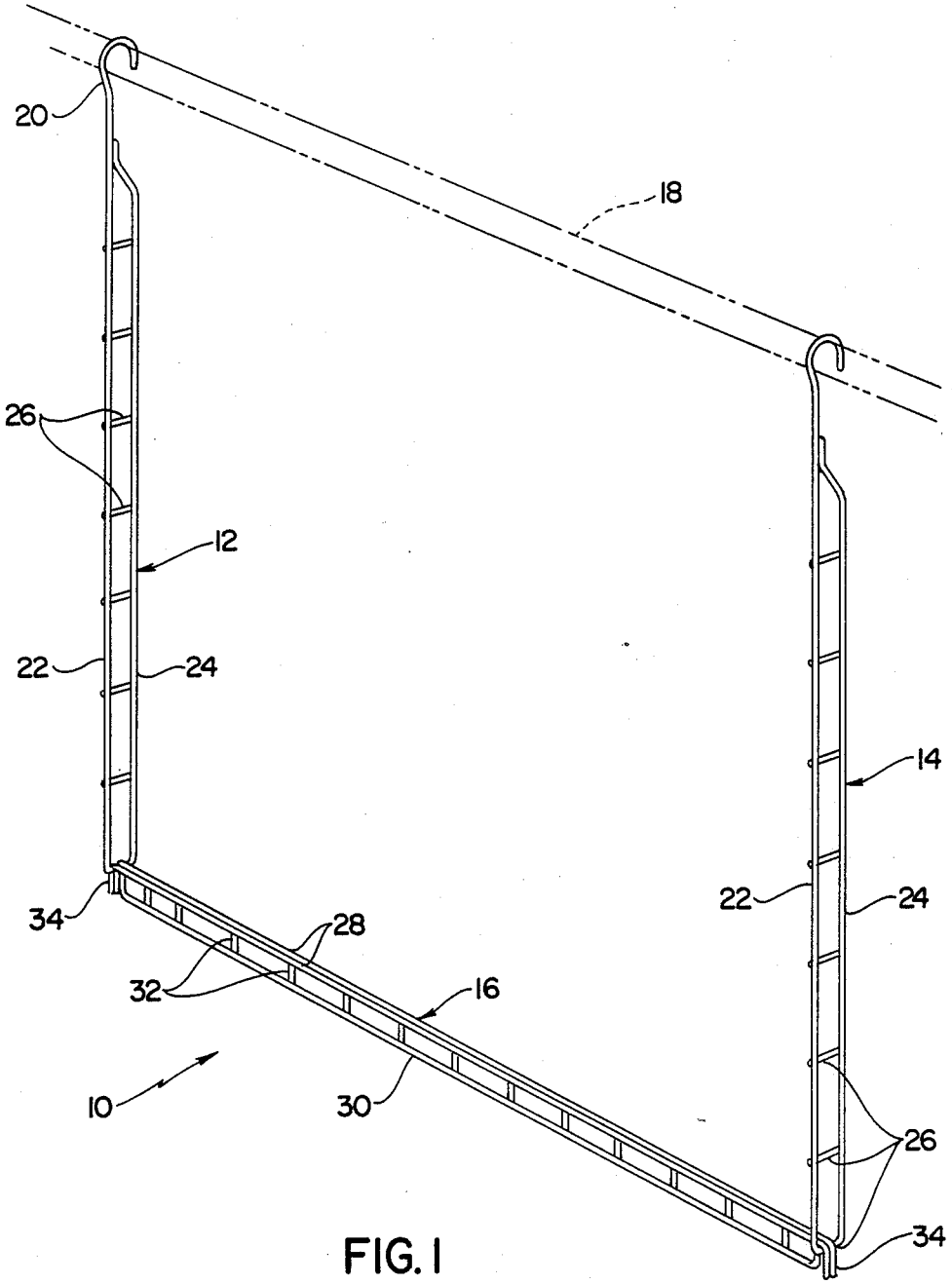
FIG. 1 is a perspective view of a first embodiment of the closet extender of the instant invention.

Referring now to the drawings, a first embodiment of the closet extender of the instant invention is illustrated and generally indicated at 10 in FIG. 1. The closet extender 10 comprises first and second frame members generally indicated at 12 and 14, respectively, and a support member generally indicated at 16. The frame members 12 and 14 are adapted to be received on a closet pole 18 in the manner illustrated so that they extend downwardly therefrom in substantially parallel spaced relation and the support member 16 is adapted to be adjustably secured to the frame members 12 and 14 so that it extends therebetween in downwardly spaced, substantially parallel relation to the closet pole 18.

The frame members 12 and 14 are preferably made of a suitable substantially rigid wire and each preferably includes an upper hook portion 20, a pair of spaced, rigid substantially parallel longitudinal frame wire elements 22 and 24, and a plurality of spaced, rigid, substantially parallel transverse connecting frame wire elements 26 which extend between the longitudinal frame wire elements 22 and 24 thereof. The hook elements 20 extend integrally from the upper ends of the longitudinal frame wire elements 22 and the longitudinal frame wire elements 22 and 24 of each of the frame members 12 and 14 are integrally connected through the lower most connecting frame wire elements 26 thereof at the lower ends of the frame members 12 and 14.

The support member 16 is preferably also constructed from a suitable substantially rigid wire and it comprises a pair of side by side upper longitudinal support wire elements 28, a lower longitudinal support wire element 30 which is disposed in downwardly spaced, substantially parallel relation to the upper longitudinal support wire elements 28, and a plurality of spaced substantially parallel, transverse connecting support wire elements 32 which extend between the longitudinal upper support wire elements 28 and the longitudinal lower support wire element 30. Also included in the support member 16 are end hooks 34 which extend integrally outwardly from the ends of the longitudinal upper support wire elements 28 and then downwardly so that they define hook-shaped members which are receivable on the transverse connecting wire elements of the frame members 12 and 14 as illustrated in FIG. 1.

For use of the closet extender 10, the frame members 12 and 14 are assembled on a closet pole 18 and the end hooks 34 of the support member 16 are assembled on a pair of the transverse connecting wire elements 26 on the frame members 12 and 14 so that the support member 16 is positioned in downwardly spaced substantially parallel relation to the closet pole 18. In this regard, because the support member 16 is adjustably securable on the frame members 12 and 14 by attaching the end hooks 34 to different transverse connecting wire elements 26 thereof, the closet extender 10 can be adapted to accommodate garments of different sizes on the closet pole 18 above the support member 16. Further, once the support member 16 has been secured to the frame members 12 and 14, the lower support wire element 30 can be utilized for suspending coat hangers having garments thereon so that the connecting support wire elements 32 maintain the coat hangers in spaced relation on the support member 16.

Figure 2:
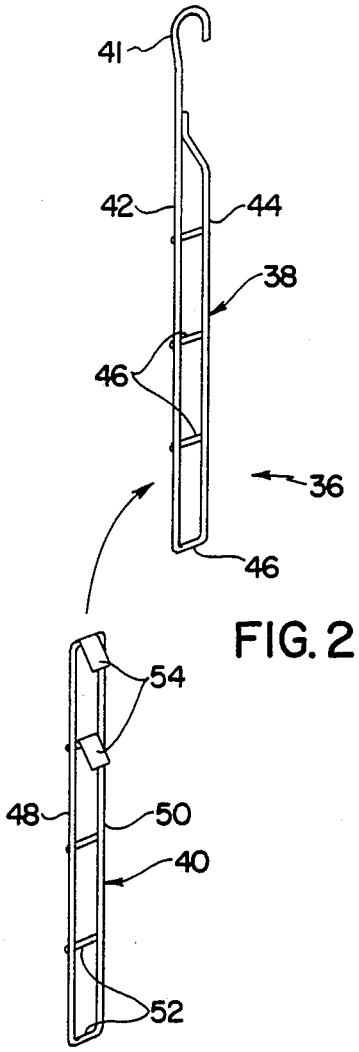
FIGS. 2 and 3 are unassembled and assembled perspective views, respectively, of one of the frame members of a second embodiment of the closet extender.
Figure 3:
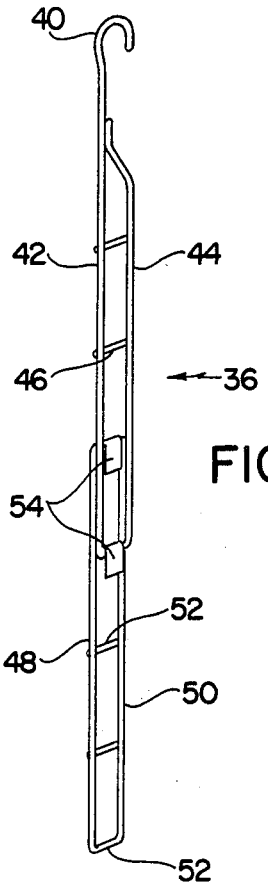

Referring now to FIGS. 2 and 3, one of the frame members of a second embodiment of the closet extender of the instant invention is illustrated and generally indicated at 36. The frame member 36 comprises upper and lower frame member sections generally indicated at 38 and 40, respectively, which are detachably connectable so that they cooperate to define an elongated frame member which is generally similar to the frame members 12 and 14. The frame member section 38 comprises a hook member 41, a pair of spaced, substantially parallel, longitudinal frame member section wire elements 42 and 44, and a plurality of connecting wire elements 46 which extend between the longitudinal frame member section wire elements 42 and 44 thereof. The hook member 41 is integrally attached to the upper end of the frame member section wire element 42 thereof and the connecting frame wire elements 46 maintain the frame member section wire elements 42 and 44 thereof in closely spaced substantially parallel relation as illustrated. The lower frame member section 40 includes a pair of rigid spaced substantially parallel longitudinal frame member section wire elements 48 and 50, a plurality of spaced substantially parallel, transverse connecting frame wire elements 52 and a pair of metal hook tabs 54 which are attached to the two uppermost transverse connecting frame wire elements 52 thereof. The connecting frame wire elements 52 maintain the longitudinal frame member section wire elements 48 and 50 in closely spaced substantially parallel relation as illustrated, and the hook tabs 54 extend downwardly from the uppermost connecting frame wire elements 52 so that they are receivable on a pair of adjacent connecting frame wire elements 46 on the upper frame member section 38. In this regard, the hook tabs 54 are preferably inwardly bendable slightly to the position illustrated in FIG. 3 to more effectively secure the bottom frame member section 40 to the upper frame member section 38, although the hook tabs 54 are preferably nevertheless outwardly bendable to disengage the upper and lower frame member sections 38 and 40, respectively. Accordingly, the frame member sections 38 and 40 are adjustably securable together so that they cooperate to define a frame member 36 of adjustable length. Further, the frame member 36 is constructed so that a pair of the frame members 36 can be assembled with a support member 16 to define a closet extender which is similar to the closet extender 10, but which has an added degree of adjustability.

It is seen therefore that the instant invention provides a closet extender which has significant advantages over the heretofore available closet extenders. Specifically, the support member 16 is adjustably securable to the frame members 12 and 14 to adapt the closet extender 10 to accommodate garments of various types and sizes. Further, the closet extender of the subject invention can also be adapted to include a pair of adjustable frame members 36 so that the closet extender has an increased degree of versatility and adjustability. Further, the closet extender of the instant invention is adapted for a variety of relatively inexpensive constructions and it is collapsible so that it can be easily stored when not in use. Hence, for these reasons as well as the other reasons hereinbefore set forth, it is seen that the closet extender of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A closet extender comprising first and second elongated frame members adapted to be suspended from a substantially horizontal closet pole so that they extend downwardly therefrom in substantially parallel spaced relation and an elongated support member adjustably securable to said frame members at a plurality of different locations wherein it extends therebetween in a substantially horizontal disposition in downwardly spaced relation to said closet pole, said support member being adapted for suspending a plurality of clothes hangers therefrom, said frame members each having upper and lower ends and each comprising a pair of spaced, substantially parallel, substantially rigid, longitudinal frame wire elements, a plurality of spaced, substantially parallel, substantially rigid connecting frame wire elements extending between the longitudinal frame wire elements thereof, and a hook element at the upper end thereof, said hook elements being receivable on said closet pole for suspending said frame members therefrom, said support member comprising support hook means at the opposite ends thereof, each of said support hook means being releasably received in engagement on a transverse connecting frame wire element of a different frame member for releasably supporting said support member on said frame members.

2. In the closet extender of claim 1, said support member comprising a pair of vertically spaced substantially parallel, substantially rigid longitudinal support wire elements and a plurality of spaced, substantially parallel, substantially rigid transverse connecting support wire elements extending therebetween.

3. In the closet extender of claim 1, each of said frame members comprising upper and lower longitudinally extending frame member sections and frame member hook means detachably connecting the upper and lower frame member sections thereof in substantially end to end relation, said support member being alternatively detachably securable to either of the frame member sections of each of said frame members.

4. In the close extender of claim 3, each of said frame member sections including a pair of spaced substantially parallel, substantially rigid longitudinal frame member section wire elements and a plurality of spaced, substantially parallel, substantially rigid transverse connecting frame wire elements extending therebetween.

* * * * *